US006085721A

United States Patent [19]

Dodi et al.

[11] Patent Number: 6,085,721

[45] Date of Patent: Jul. 11, 2000

[54] BAR ENGINE BRAKE

[75] Inventors: Sotir Dodi; Ronald B. Wahl, both of Windsor; David Courcy, Amston; Sanjay Patel, Windsor, all of Conn.

[73] Assignee: Diesel Engine Retarders, Inc., Wilmington, Del.

[21] Appl. No.: 09/145,243

[22] Filed: Sep. 2, 1998

Related U.S. Application Data

[60] Provisional application No. 60/080,597, Apr. 3, 1998.

[51] Int. Cl.[7] ..... F02D 13/04

[52] U.S. Cl. ..... 123/321

[58] Field of Search ..... 123/198 F, 321

[56] References Cited

U.S. PATENT DOCUMENTS

| | | | |
|---|---|---|---|
| 4,164,917 | 8/1979 | Glasson | 123/321 |
| 4,711,210 | 12/1987 | Reichenbach | 123/321 |
| 5,000,146 | 3/1991 | Szucsanyi . | |
| 5,086,738 | 2/1992 | Kubis et al. . | |
| 5,150,678 | 9/1992 | Wittmann et al. . | |
| 5,161,500 | 11/1992 | Kubis et al. . | |
| 5,161,501 | 11/1992 | Hu | 123/324 |
| 5,273,013 | 12/1993 | Kubis et al. . | |
| 5,460,131 | 10/1995 | Usko | 123/321 |
| 5,462,025 | 10/1995 | Israel et al. | 123/321 |
| 5,586,533 | 12/1996 | Feucht | 123/321 |
| 5,595,158 | 1/1997 | Faletti et al. | 123/321 |
| 5,611,308 | 3/1997 | Hackett | 123/321 |
| 5,619,963 | 4/1997 | Faletti et al. | 123/321 |
| 5,692,469 | 12/1997 | Rammer et al. . | |
| 5,730,102 | 3/1998 | Arnold et al. . | |

FOREIGN PATENT DOCUMENTS

| | | |
|---|---|---|
| 96/29508 | 9/1996 | WIPO . |

*Primary Examiner*—Noah P. Kamen

*Attorney, Agent, or Firm*—Collier Shannon Scott, PLLC

[57] ABSTRACT

The present invention is directed to a control system for controlling operation of an engine compression release brake for an engine. The control system includes a valve actuation assembly for actuating at least one valve during a predetermined engine operating condition. The control system also includes an energy supply assembly for supplying energy to operate the valve actuation assembly. The control system includes a control assembly for controlling the operation of valve actuation assembly.

11 Claims, 5 Drawing Sheets

BAR ENGINE BRAKE

CROSS REFERENCE TO RELATED PATENT APPLICATION

This application relates to and claims priority on Provisional Application Ser. No. 60/080,597 filed Apr. 3, 1998, entitled "Bar Engine Brake."

FIELD OF THE INVENTION

The present invention relates to the control of an engine compression release brake. In particular, the present invention relates to a control assembly for controlling an engine compression release brake using exhaust manifold pressure variation.

BACKGROUND OF THE INVENTION

U.S. Pat. No. 5,000,146 to Szucsany, discloses a motor brake for a diesel engine that uses an injection pump to supply energy to hold the exhaust valve open during a compression stroke.

U.S. Pat. Nos. 5,161,500 and 5,273,013 to Kubis et al. disclose devices for controlling the operation of an exhaust valve during an engine brake mode. Kubis uses a second pressure chamber to build up pressure to activate the exhaust valve during the compression stroke.

U.S. Pat. No. 5,692,469 to Rammer et al. is directed to a method for braking a four stroke internal combustion engine. The method utilizes a choke device to choke the flow of exhaust gas in the outlet system to increase pressure. The increase in pressure is used to open an exhaust valve such that exhaust gas flows back into a combustion chamber. A control device is used to maintain the exhaust valve in a partially open position during a subsequent compression stroke of the engine.

U.S. Pat. No. 5,730,102 to Arnold et al. is directed to an engine brake device for a commercial vehicle. The device utilizes an electromagnetically-operated setting device to operate the valve actuating device during a braking operation.

OBJECTS OF THE INVENTION

It is an object of the present invention to provide a system for controlling an engine compression release brake using exhaust manifold pressure variation.

It is another object of the present invention to a system for controlling an engine compression release brake using exhaust manifold pressure variation created by a restrictor.

It is another object of the present invention to a system for controlling an engine compression release brake using exhaust manifold pressure variation created by an exhaust brake.

It is another object of the present invention to provide an engine brake having a simple design.

It is another object of the present invention to provide an engine brake that does not require the use of control assemblies, such as, for example, switches, solenoids and control valves.

It is another object of the present invention to provide an engine brake that significantly reduces the supplementary loads applied to the valve train during a braking operation.

It is another object of the present invention to provide a system for controlling and engine compression release brake having improved reliability.

BRIEF SUMMARY OF THE INVENTION

The present invention is directed to a control system for controlling operation of an engine compression release brake for an engine. The control system includes a valve actuation assembly for actuating at least one valve during a predetermined engine operating condition. The control system also includes an energy supply assembly for supplying energy to operate the valve actuation assembly. The control system includes a control assembly for controlling the operation of valve actuation assembly.

The valve actuation assembly operates the at least one valve during an engine braking operating condition. The control system further may further a housing. The valve actuation assembly, the energy supply assembly, and the control assembly are located within the housing. The energy supply assembly may include an assembly for supplying hydraulic fluid to the valve actuation assembly to operate the at least one valve during predetermined engine operating conditions.

The control assembly may permit the valve actuation assembly to open the at least one valve for a predetermined time period during an engine braking operation. The control assembly may disable the valve actuation assembly during positive power such that the valve actuation assembly does not actuate the at least one valve.

The valve actuation assembly may include an actuator assembly for actuating the at least one valve during an engine braking operation, and an actuator control assembly for preventing the supply of energy from the energy supplying assembly during predetermined engine operating conditions and for activating the control assembly during the predetermined engine operating conditions. The actuator assembly may include an activating assembly for activating the control assembly during positive power to disable the actuator assembly from operating the at least one valve.

The control system may further include a housing. The valve actuation assembly, the energy supply assembly, and the control assembly are located within the housing. The energy supply assembly may include an assembly for supplying hydraulic fluid to the valve actuation assembly to operate the at least one valve during predetermined engine operating conditions. The activating assembly may block the assembly for supplying hydraulic fluid at predetermined intervals during positive power. Additionally, the activating assembly may block the assembly for supplying hydraulic fluid at predetermined intervals during an engine braking operation.

The control assembly may include at least one passageway located within the housing. The activating assembly opens at least one of the at least one passageway to drain hydraulic fluid from the valve actuation assembly during positive power. The actuator control assembly opens at least one of the at least one passageway to drain hydraulic fluid from the valve actuation assembly during an engine braking operation to control the opening of the at least one valve. The hydraulic fluid is drained to limit the opening of the at least one valve.

Additionally, the control assembly may include two passageways located in the housing and the actuator control assembly opens both of the two passageways to drain hydraulic fluid from the valve actuation assembly. The hydraulic fluid is drained to limit the opening of the at least one valve.

It is to be understood that both the foregoing general description and the following detailed description are exemplary and explanatory only. And are not restrictive of the invention as claimed. The accompanying drawings, which are incorporated herein by reference and which constitute a part of the specification, illustrate certain embodiments of the invention and, together with the detailed description, serve to explain the principles of the present invention.

BRIEF DESCRIPTION OF THE DRAWINGS

The present invention will now be described in connection with the following figures in which like reference numbers refer to like elements and wherein.

DETAILED DESCRIPTION OF THE INVENTION

Figure 1:
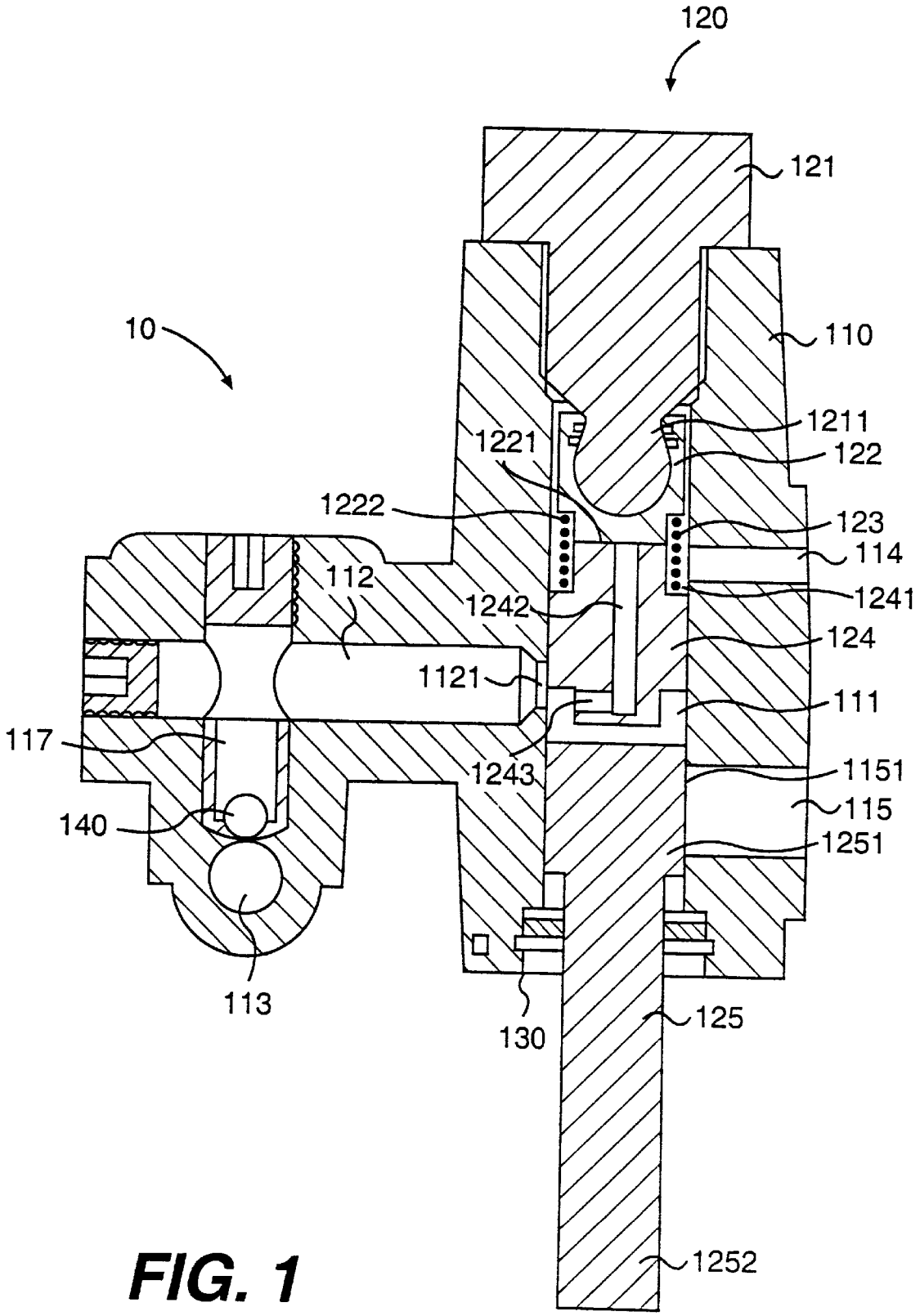
FIG. 1 is a side view of the control assembly for controlling an engine compression release brake according to an embodiment of the present invention.

A control assembly 10 for controlling an engine compression release brake, not shown, is disclosed. The control assembly 10 may take the form of an engine brake assembly, as illustrated in FIG. 1. The engine brake assembly 10 uses variations in exhaust manifold pressure to control compression release braking.

The engine brake assembly 10 includes a housing assembly 110. The housing assembly 110 includes a plurality of passageways formed therein. The passageways are capable of receiving hydraulic fluid therein, such as, for example, engine oil. The housing assembly 110 includes a first passageway 111 that extends therethrough, as shown in FIG. 1. An exhaust valve actuating assembly 120 is located therein. The housing assembly 110 also includes a second passageway 112 that extends substantially orthogonal to the first passageway 111. The second passageway 112 is fluidically connected to the first passageway 111. A third passageway 113 is fluidically connected to second passageway 112. Hydraulic fluid is supplied to the engine brake assembly 10 through the third passageway 113. The third passageway 113 is preferably a low pressure oil feeding passageway.

The housing assembly 110 further includes a fourth passageway 114 and a fifth passageway 115. Each of the fourth passageway 114 and the fifth passageway 115 is fluidically connected to the first passageway 111 and extend substantially orthogonal thereto. When open, the fourth passageway 114 and the fifth passageway 115 drain hydraulic fluid from the engine brake assembly 10.

It is contemplated by the present inventors that the orientation of passageways 111, 112, 113, 114, and 115 within the housing assembly 110 may be modified based upon such factors as engine configuration and size.

The valve actuating assembly 120 is located within the first passageway 111 in the housing assembly 110. The valve actuating assembly 120 includes a cap assembly 121 for closing one end of the first passageway 111. The cap assembly 121 includes an attachment assembly 1211 located at one end thereof. A sealing assembly 122 is movably mounted to the attachment assembly 1211. The attachment assembly 1211 may include a ball assembly. The sealing assembly 122 may include a complementary socket assembly. It, however, is contemplated that the present invention is not limited to the connection assembly described above; rather other assemblies for connecting the cap assembly 121 and the sealing assembly 122 are considered to be well within the scope of the present invention. The sealing assembly 122 includes a sealing surface 1221. The function and operation of the sealing surface 1221 will be described in detail below.

The valve actuating assembly 120 further includes a biasing assembly 123. The biasing assembly 123 may be a coil spring assembly. It, however, is contemplated that other suitable biasing assemblies may be substituted for the coil spring assembly. The biasing assembly 123 may be connected to the sealing assembly 122.

The valve actuating assembly 120 further includes a first piston assembly 124. The first piston assembly 124 is slidably received within the first passageway 111. The biasing assembly 123 contacts a portion of the first piston assembly 124 to provide a biasing force thereon. The sealing assembly 122 and the first piston assembly 124 may each include a recessed portion 1222 and 1241 that is adapted to receive the biasing assembly 123 therein.

The first piston assembly 124 further includes a central passageway 1242 formed therein. A lower end of the first piston assembly 124 includes an air bleed passageway 1243 that is fluidically connected to the central passageway 1242. The passageway 1243 permits the flow of air from the passageway 111 and hydraulic fluid from the second passageway 112 to the central passageway 1242 when the first piston assembly 124 is located at a particular location within the first passageway 111. The second passageway 112 includes an opening 1121 located at one end therein, which opens into the first passageway 111. The first piston assembly 124 is capable of sealing the opening 1121 preventing the flow of hydraulic fluid from the second passageway 112 to the first passageway 111.

Figure 4:
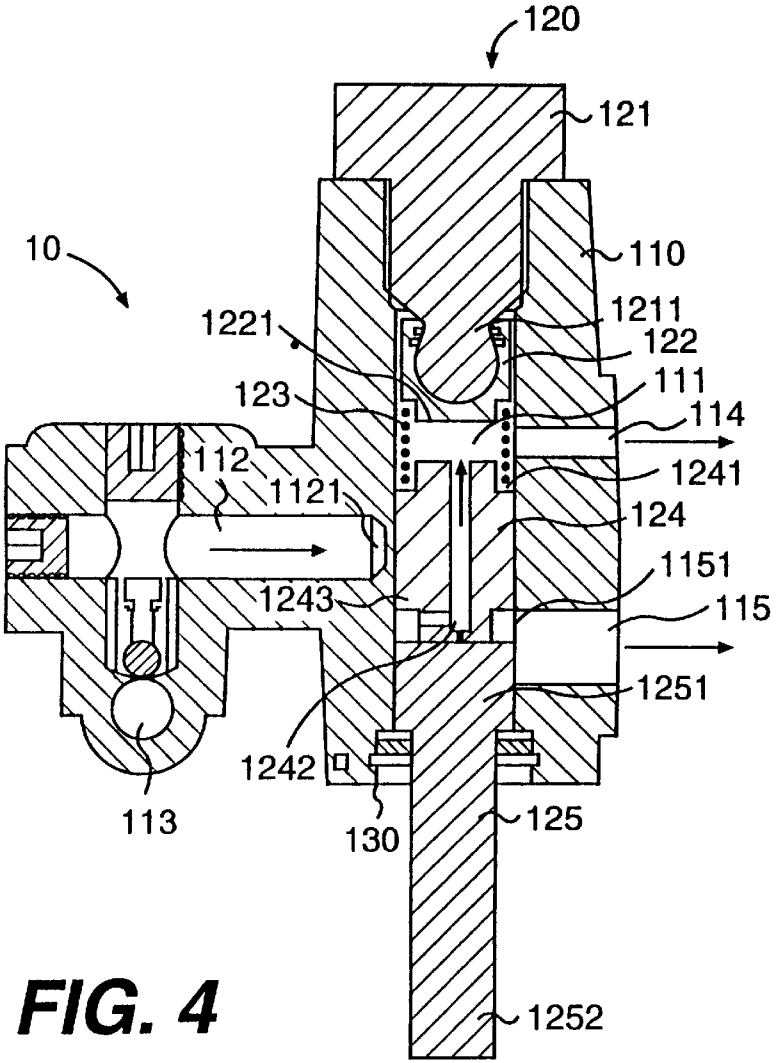
FIG. 4 is a side view of the control assembly of FIG. 1 during the exhaust stroke when the exhaust valve is in an open position.

The valve actuating assembly 120 further includes a second piston assembly 125. The second piston assembly 125 includes a first portion 1251 that is located within the first passageway 111 and a second portion 1252 that extends from the housing assembly 110. The second portion 1252 of the second piston assembly 125 is adapted to engage the exhaust valve to facilitate opening and closing of the valve to effectuate a compression release braking event. The first portion 1251 of the second piston assembly 125 is adapted to be engaged by the first piston assembly 124 during the exhaust stroke, as shown in FIG. 4. The first portion 1251 of the second piston assembly 125 is capable of sealing an opening 1151 in the fourth passageway 115 to prevent the flow of hydraulic fluid into the fourth passageway 115 during predetermined intervals, discussed below.

A stopper assembly 130 is located at one end of the first passageway 111 surrounding a portion of the second end 1252 of the second piston assembly 125. The stopper assembly 130 secures the second piston assembly 125 within the first passageway 111. Furthermore, the stopper assembly 130 limits the downward travel of the second piston assembly 125. The stopper assembly 130 may include a retaining washer 131 and a retaining ring 132. The retaining ring 132 mounted within a recess 116 in the housing assembly 110.

A valve assembly 140 is located within the housing assembly 110 to control the flow of hydraulic fluid from the third passageway 113 to the second passageway 112. The valve assembly 140 is located within a channel 117 formed within the housing assembly 110. The valve assembly 140 is preferably a check valve to prevent the backflow of hydraulic fluid from the second passageway 112 to the third passageway 113. The check valve may comprise a ball and seat valve. It, however, is contemplated that other suitable means for preventing the backflow of hydraulic fluid may be employed to prevent the backflow of hydraulic fluid from the second passageway 112 to the third passageway 113.

The figures provide an illustration of the engine brake assembly 10 as it relates to a single exhaust valve. The engine brake assembly 10 includes a similar structure for each engine cylinder. Furthermore, the disclosure describes the actuation of a single exhaust valve for each cylinder. It is contemplated by the present inventors that more than one exhaust valve for an engine cylinder may be operated by the engine brake assembly 10.

Operation of Control Assembly During Positive Power

The operation of the control assembly 10 will now be described during positive power and a braking operation. During positive power, hydraulic fluid from the third passageway 113 enters the second passageway 112 through the valve assembly 140. The hydraulic fluid then enters the first passageway 111 through the opening 1121. The presence of the hydraulic fluid within the first passageway 111 biases the first piston assembly 124 in an upward direction against the bias of the biasing assembly 123. The hydraulic fluid also biases the second piston assembly 125 in a downward direction so that it is in contact with the actuating assembly (i.e., crosshead) for the at least one exhaust valve. The downward travel of the exhaust valve is greater during positive power as compared to its travel during a braking operation. As a result, the second piston assembly 125 moves a sufficient distance under the influence of the hydraulic fluid pressure such that the opening 1151 to the fifth passageway 115 is exposed, as shown in FIG. 4. At this point hydraulic fluid is permitted to drain through the fifth passageway 115. This drainage of hydraulic fluid results in a loss of hydraulic fluid pressure within the first passageway 111. This causes the first piston assembly 124 to be biased in a downward direction such that the opening 1121 between the first passageway 111 and the second passageway 112 is closed, as shown in FIG. 4. As a result, hydraulic fluid does not enter the first passageway 111 from the second passageway 112. Hydraulic fluid is also permitted to drain from the first passageway 111 to the fourth passageway 114 through the passageways 1242 and 1243 in the first piston assembly 124. The downward travel of the second piston assembly 125 is limited when the lower end of the first portion 1251 contacts the stopper assembly 130. At this point, the second portion 1252 of the second piston assembly 125 loses contact with the at least one exhaust valve.

Figure 5:
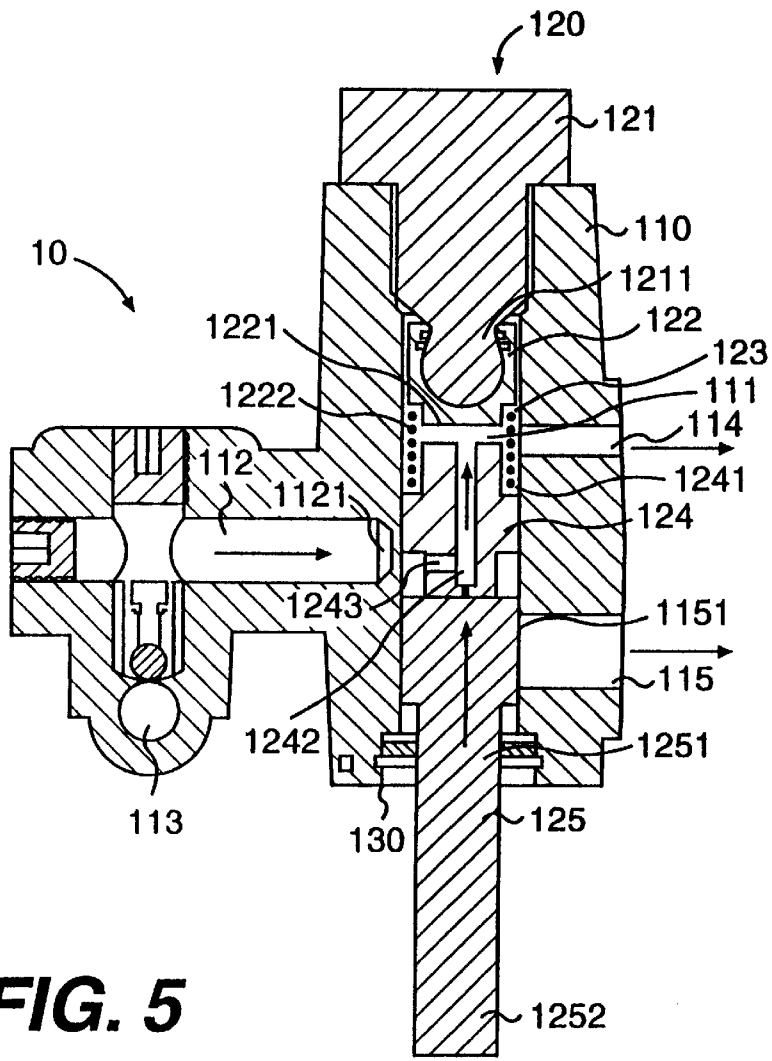
FIG. 5 is a side view of the control assembly of FIG. 1 at the end of the exhaust stroke when the exhaust valve is closing.

As the exhaust valve returns to the closed position, the second portion 1252 of the second piston assembly 125 then reestablishes contact with the exhaust valve. At this point, the second piston assembly 125 moves in upward position such that the opening 1151 to the fifth passageway 115 is closed, which prevents the flow of hydraulic fluid from the first passageway 111 to the fifth passageway 115, as shown in FIG. 5. The upper surface of the second piston assembly 125 which is in contact with the lower surface of the first piston assembly 124, moves the first piston assembly 124 to expose the opening 1121 between the first passageway 111 and the second passageway 112. This reintroduces the flow of hydraulic fluid into first passageway 111. This causes the first piston assembly 124 to be biased in an upward direction to the position shown in FIGS. 1–3. This operation of the control assembly 10 is repeated during each exhaust valve opening operation.

Operation of Control Assembly During Engine Braking

Figure 3:
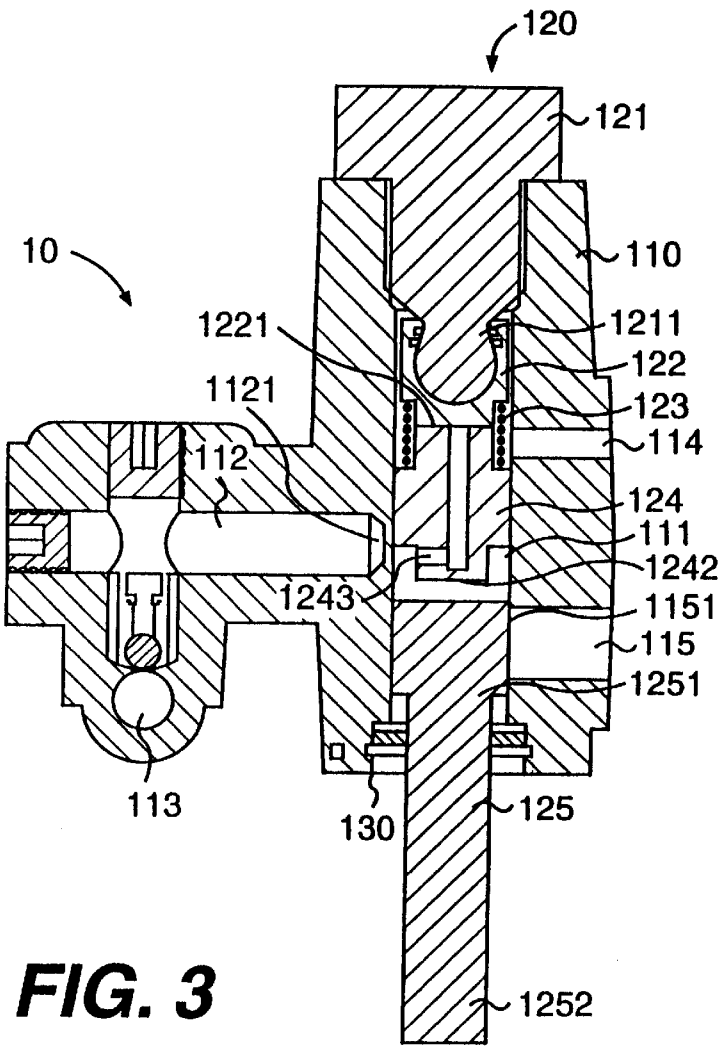
FIG. 3 is a side view of the control assembly of FIG. 1 at the initiation of a braking event.
Figure 2:
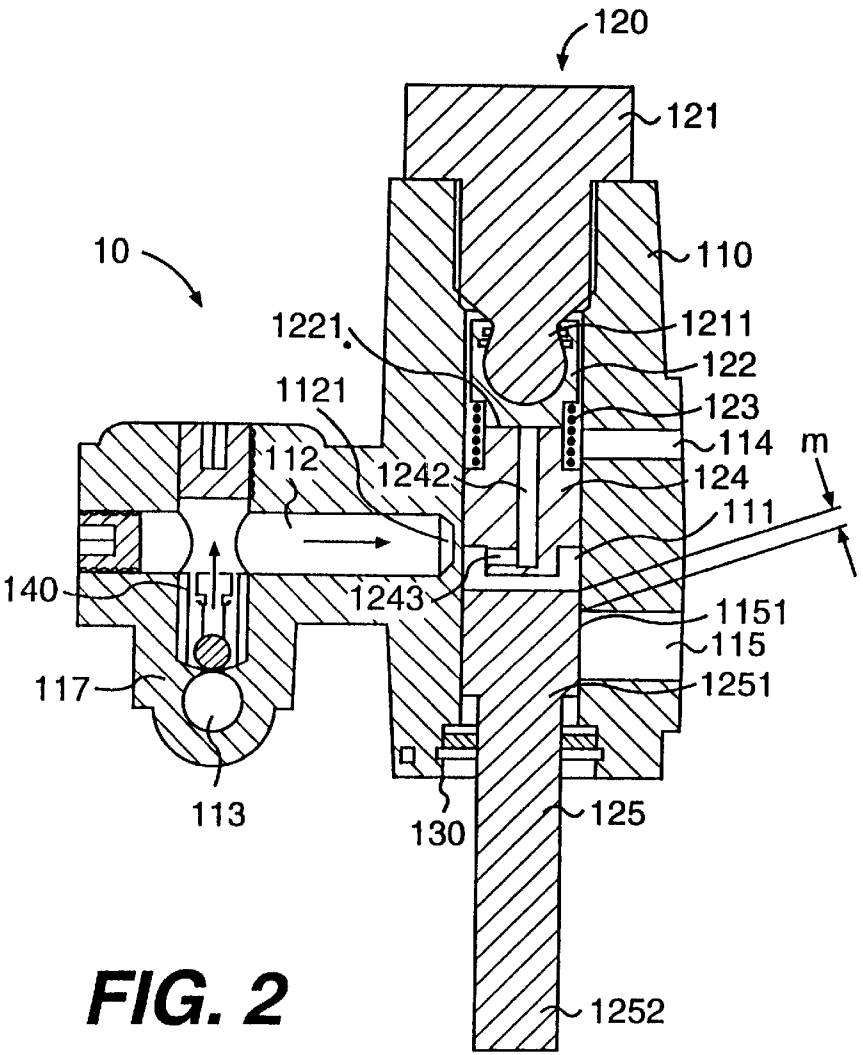
FIG. 2 is a side view of the control assembly of FIG. 1 when the exhaust valve is closed at the beginning of the intake stroke.
Figure 6:
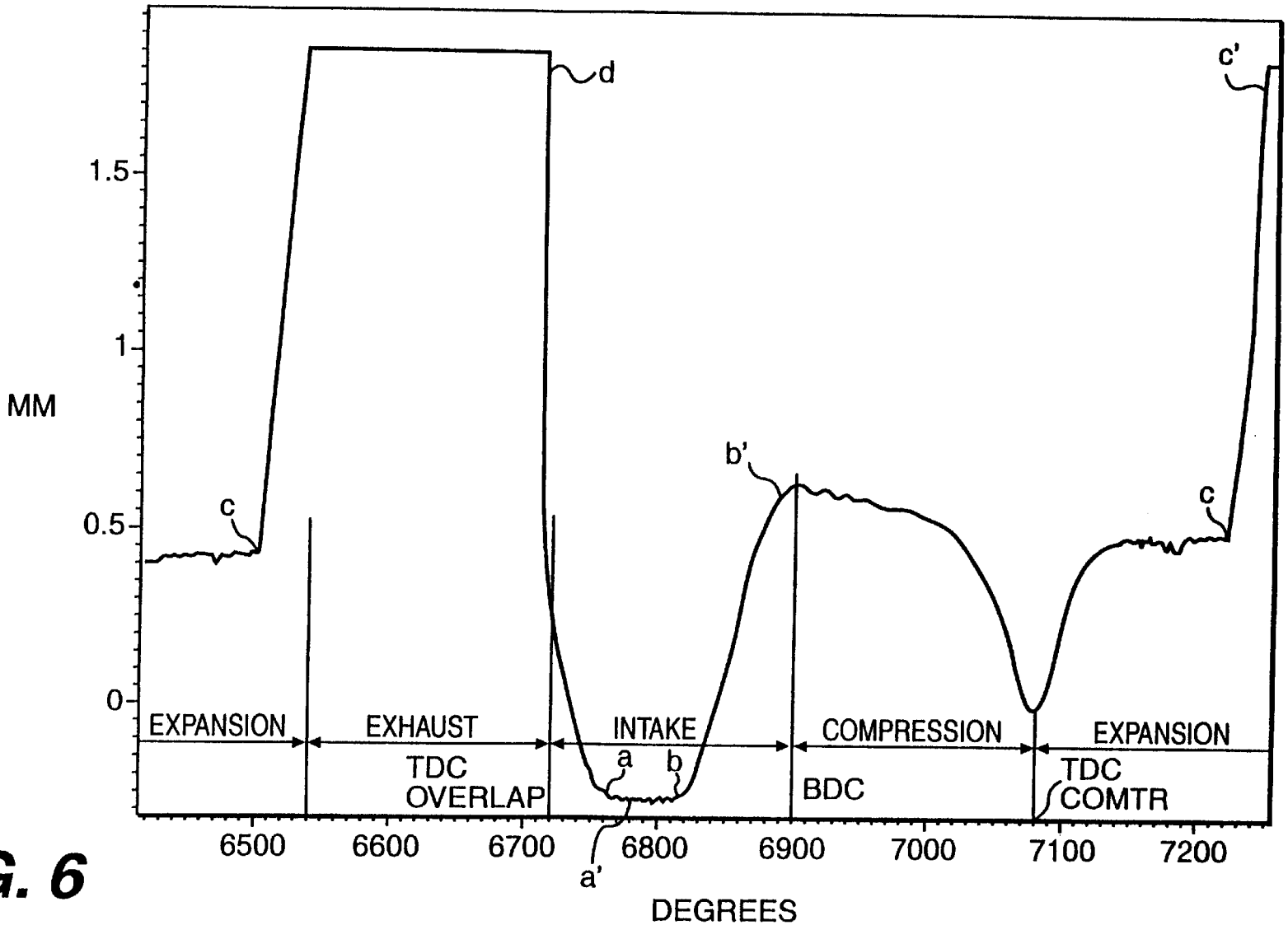
FIG. 6 is graph depicting exhaust valve motion in accordance with the present invention.

The operation of the control assembly 10 will now be described in connection with FIG. 6. FIG. 6 tracks exhaust valve motion when the restrictor in the exhaust manifold is "ON." The position of the control assembly 10 during the intake stroke, between points a' and b in FIG. 6, is depicted in FIG. 2. The exhaust valve is closed and the piston 124 is in an uppermost position. The position of the control assembly 10 during the brake event, between points b' and c in FIG. 6, is depicted in FIG. 3. The exhaust valve is open for a braking event. The position of the control assembly 10 during the exhaust stroke, between points c' and d in FIG. 6, is depicted in FIG. 4. The position of the control assembly 10 during the first part of the intake stroke when piston 124 moves upward, between points a and a' in FIG. 6, is depicted in FIG. 5. The piston 124 moves upward under the supply of oil pressure.

The piston 125 moves between the positions shown in FIGS. 2 and 3 between points b–b' in FIG. 6. The pistons 124 and 125 move between the positions shown in FIGS. 3 and 4 between points C–C' in FIG. 6. The pistons 124 and 125 move between the positions shown in FIGS. 4 and 5 between points d-a in FIG. 6.

During the intake stroke, the exhaust valve is closed, as depicted in FIG. 6. As described above in connection with the operation during positive power, hydraulic fluid from the third passageway 113 enters the second passageway 112 through the valve assembly 140. The hydraulic fluid then enters the first passageway 111 through the opening 1121. The presence of the hydraulic fluid within the first passageway 111 biases the first piston assembly 124 in an upward direction against the bias of the biasing assembly 123. The hydraulic fluid also biases the second piston assembly 125 in a downward direction so that it is in contact with at least one exhaust valve.

The presence of the hydraulic fluid within the first passageway 111 causes the second piston assembly 125 to move into contact with the crosshead of the at least one exhaust valve. When the exhaust valve opens (float) during the intake stroke, due to the pulse of pressure in the exhaust manifold created by a restrictor, which is turned on for braking, the piston 125 moves downward. The piston 125 is pushed against the exhaust valve crosshead stem by spring 123 and the oil supply pressure, as shown in FIG. 3. The control assembly 10 designed for each engine so that the dimension m, shown in FIG. 2 is larger than maximum exhaust valve float on the intake stroke. On the subsequent compression stroke, the exhaust valve tends to close, due to an increase in cylinder pressure, but it is kept open due to a hydraulic lock created between pistons 125, 124 and check valve 117. By keeping the exhaust valve open on the compassion stroke (up to about 2.0 mm), air is pumped by piston in the exhaust manifold, destroying a part of compression work and thereby creating retarding power. During the expansion stroke, the standard actuating assembly for the exhaust valve, such as, for example, a rocker arm, causes the at least one exhaust valve to fully open.

At this point, the at least one exhaust valve loses contact with the second portion 1252 of the second piston assembly 152. As a result, the second piston assembly 125 moves a sufficient distance under the influence of the hydraulic fluid pressure such that the opening 1151 to the fifth passageway 115 is exposed, as shown in FIG. 4. At this point hydraulic fluid is permitted to drain through the fifth passageway 115. This drainage of hydraulic fluid results in a loss of hydraulic fluid pressure within the first passageway 111. This causes the first piston assembly 124 to be biased in a downward direction by the biasing assembly 123 such that the opening 1121 between the first passageway 111 and the second passageway 112 is closed, as shown in FIG. 4. Hydraulic fluid does not enter the first passageway 111 from the second passageway 112. Hydraulic fluid is also permitted to drain from the first passageway 111 to the fourth passageway 114 through the passageways 1242 and 1243 in the first piston assembly 124.

As the exhaust valve returns to the closed position in response to the standard actuating assembly, the second portion 1252 of the second piston assembly 125 then reestablishes contact with the exhaust valve. At this point, the second piston assembly 125 moves in upward position, as illustrated in FIG. 5. The opening 1151 to the fifth passageway 115 is closed, which prevents the flow of hydraulic fluid from the first passageway 111 to the fifth passageway 115. At this time, the upper surface of the second piston assembly 125 contacts the lower surface of the first piston assembly 124. This causes the first piston assembly 124 to move and expose the opening 1121 between the first passageway 111 and the second passageway 112. This reintroduces the flow of hydraulic fluid into first passageway 111. This causes the first piston assembly 124 to be biased in an upward direction to the position shown in FIGS. 1–3. The above-described operation of the control assembly 10 is repeated when the restrictor is "ON."

Additional Embodiments

Figure 7:
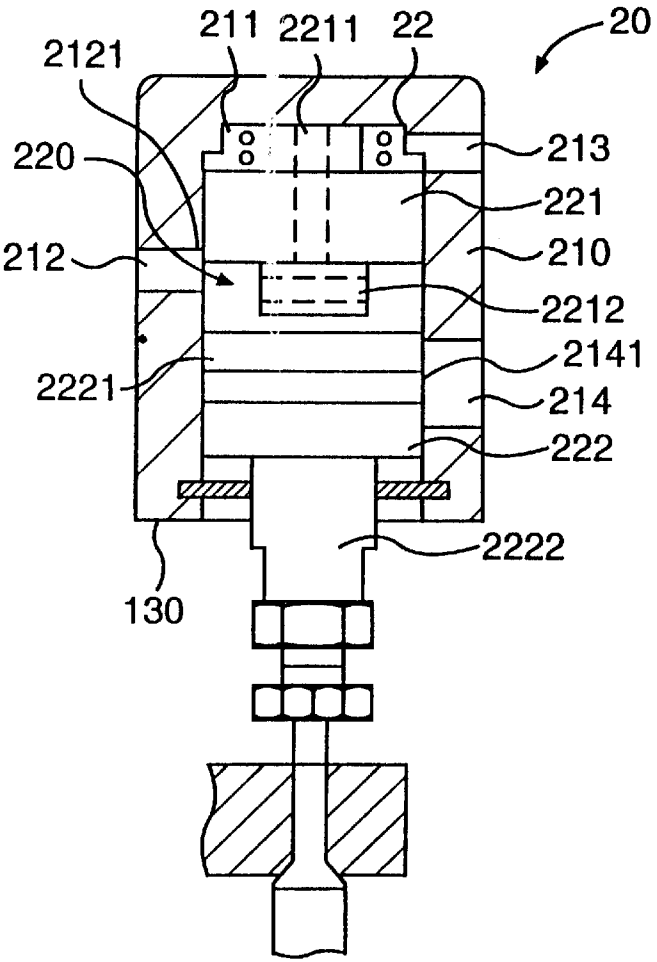
FIG. 7 is a side view of a control assembly for controlling an engine compression release brake according to another embodiment of the present invention.

An alternate embodiment of the control assembly is illustrated in FIG. 7. The control assembly 20 is an engine brake assembly and includes a housing assembly 210. The housing assembly 210 includes a plurality of passageways formed therein. The housing assembly 210 includes a first passageway 211 that extends therethrough. An exhaust valve actuating assembly 220 is located therein. The housing assembly 210 also includes a second passageway 212 that extends substantially orthogonal to the first passageway 211. The second passageway 212 is fluidically connected to the first passageway 211. Hydraulic fluid is supplied to the engine brake assembly 20 through the second passageway 212.

The housing assembly 210 further includes a third passageway 213 and a fourth passageway 214. Each of the third passageway 213 and the fourth passageway 214 is fluidically connected to the first passageway 211 and extend substantially orthogonal thereto. When open, the third passageway 213 and the fourth passageway 214 drain hydraulic fluid from the engine brake assembly 20.

The valve actuating assembly 220 is located within the first passageway 211 in the housing assembly 210. The valve actuating assembly 220 includes a biasing assembly 22. The biasing assembly 22 may be a coil spring assembly. It, however, is contemplated that other suitable biasing assemblies may be substituted for the coil spring assembly.

The valve actuating assembly 220 further includes a first piston assembly 221. The first piston assembly 221 is slidably received within the first passageway 211. The biasing assembly 22 contacts a portion of the first piston assembly 221 to provide a biasing force thereon.

The first piston assembly 221 further includes a central passageway 2211 formed therein. A lower end of the first piston assembly 221 includes a supply passageway 2212 that is fluidically connected to the central passageway 2211. The supply passageway 2212 permits the flow of hydraulic fluid from the second passageway 212 to the central passageway 2212 when the first piston assembly 221 is located at a particular location within the first passageway 211 and of the air entrapped in passageway 211 (between 221 and 222). The second passageway 212 includes an opening 2121 located at one end therein, which opens into the first passageway 211. The first piston assembly 221 is capable of sealing the opening 2121 preventing the flow of hydraulic fluid from the second passageway 212 to the first passageway 211.

The valve actuating assembly 220 further includes a second piston assembly 222. The second piston assembly 222 includes a first portion 2221 that is located within the first passageway 211 and a second portion 2222 that extends from the housing assembly 210. The second portion 2222 of the second piston assembly 222 is adapted to engage the exhaust valve to facilitate opening and closing of the valve to effectuate a compression release braking event. The first portion 2221 of the second piston assembly 222 is adapted to be engaged by the first piston assembly 221 during the exhaust stroke, in a similar manner as described above in connection with the control assembly 10. The first portion 2221 of the second piston assembly 222 is capable of sealing an opening 2141 in the fourth passageway 214 to prevent the flow of hydraulic fluid into the fourth passageway 214 during predetermined intervals, discussed above in connection with the control assembly 10.

A stopper assembly 130 is located at one end of the first passageway 211. The stopper assembly 130 secures the second piston assembly 222 within the first passageway 211 and limits the downward travel of the second piston assembly 222.

Figure 8:
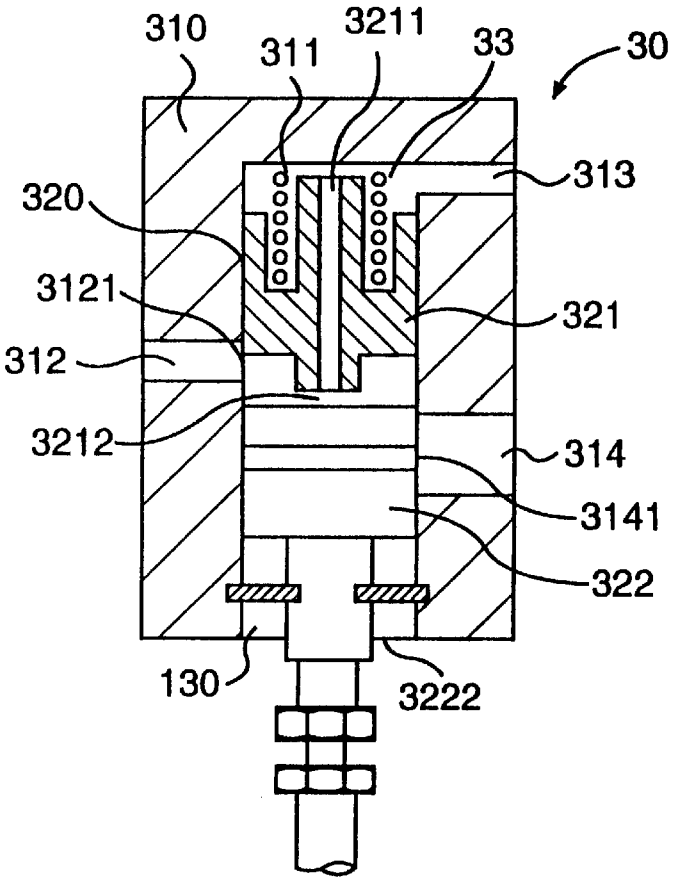
FIG. 8 is a side view of a control assembly for controlling an engine compression release brake according to another embodiment of the present invention.

An another embodiment of the control assembly is illustrated in FIG. 8. The control assembly 30 is an engine brake assembly and includes a housing assembly 310. The housing assembly 310 includes a plurality of passageways formed therein. The housing assembly 310 includes a first passageway 311 that extends therethrough. An exhaust valve actuating assembly 320 is located therein. The housing assembly 310 also includes a second passageway 312 that extends substantially orthogonal to the first passageway 311. The second passageway 312 is fluidically connected to the first passageway 311. Hydraulic fluid is supplied to the engine brake assembly 30 through the second passageway 312.

The housing assembly 310 further includes a third passageway 313 and a fourth passageway 314. Each of the third passageway 313 and the fourth passageway 314 is fluidically connected to the first passageway 311 and extend substantially orthogonal thereto. When open, the third passageway 313 and the fourth passageway 314 drain hydraulic fluid from the engine brake assembly 30, as described above in connection with the control assembly 10.

The valve actuating assembly 320 is located within the first passageway 311 in the housing assembly 310. The valve actuating assembly 320 includes a biasing assembly 33.

The valve actuating assembly 320 further includes a first piston assembly 321. The first piston assembly 321 is slidably received within the first passageway 311. The biasing assembly 33 contacts a portion of the first piston assembly 321 to provide a biasing force thereon.

The first piston assembly 321 further includes a central passageway 3211 formed therein. A lower end of the first piston assembly 321 includes a supply passageway 3212 that is fluidically connected to the central passageway 3211. The supply passageway 3212 permits the flow of hydraulic fluid from the second passageway 312 to the central passageway 3211 when the first piston assembly 321 is located at a particular location within the first passageway 311. The second passageway 312 includes an opening 3121 located at one end therein, which opens into the first passageway 311. The first piston assembly 321 is capable of sealing the opening 3121 preventing the flow of hydraulic fluid from the second passageway 312 to the first passageway 311.

The valve actuating assembly 320 further includes a second piston assembly 322. The second piston assembly 322 includes a first portion 3221 that is located within the first passageway 311 and a second portion 3222 that extends from the housing assembly 310. The second portion 3222 of the second piston assembly 322 is adapted to engage the exhaust valve to facilitate opening and closing of the valve to effectuate a compression release braking event. The first portion 3221 of the second piston assembly 322 is adapted to be engaged by the first piston assembly 321 during the exhaust stroke, in a similar manner as described above in connection with the control assembly 10. The first portion 3221 of the second piston assembly 322 is capable of sealing an opening 3141 in the fourth passageway 314 to prevent the flow of hydraulic fluid into the fourth passageway 314 during predetermined intervals, discussed above in connection with the control assembly 10.

While this invention has been described in conjunction with specific embodiments thereof, it is evident that many alternatives, modifications and variations will be apparent to those skilled in the art. Accordingly, the preferred embodiments of the invention as set forth herein we intended to be illustrative, not limiting. Various changes may be made without departing from the spirit and scope of the invention as defined in the following claims.

What is claimed is:

1. A control assembly for controlling operation of at least one valve of an engine having a plurality of engine operating conditions, said control assembly controlling the operation of the at least one valve during a predetermined engine operating condition of the plurality of engine operating conditions, said control assembly comprising:

a housing having a passageway formed therein;

a valve actuating assembly located within said passageway for actuating the at least one valve during the predetermined engine operating condition;

supply means for supplying hydraulic fluid to said passageway to operate said valve actuating assembly; and, control means for controlling the operation of said valve actuating assembly to permit operation of the at least one valve during the predetermined engine operating condition, wherein said control means comprises a movable assembly located within said passageway, wherein said movable assembly is capable of temporarily cutting off the supply of hydraulic fluid from said supply means to said passageway, and drainage means for selectively draining hydraulic fluid from said passageway during the plurality of engine operating conditions, wherein said drainage means includes at least a first drainage passageway and a second drainage passageway in said housing, wherein said first drainage passageway and said second drainage passageway are in fluid communication with said passageway.

2. The control assembly according to claim 1, wherein said control means disables said valve actuation means during positive power such that said valve actuation assembly does not actuate the at least one valve.

3. The control assembly according to claim 1, wherein said movable assembly blocks said supply means at predetermined intervals during a positive power engine operating condition.

4. The control assembly according to claim 1, wherein said movable assembly blocks said supply means at predetermined intervals during an engine braking operation.

5. The control assembly according to claim 1, wherein said valve actuating assembly opens one of said first passageway and said second passageway to drain hydraulic fluid from said passageway during positive power.

6. The control assembly according to claim 5, wherein said valve actuating assembly opens said first drainage passageway during positive power.

7. The control assembly according to claim 6, wherein said hydraulic fluid is drained to limit the opening of the at least one valve.

8. The control assembly according to claim 1, wherein said movable assembly opens one of said first passageway and said second passageway to drain hydraulic fluid from said passageway during an engine braking operation.

9. The control assembly according to claim 8, wherein said hydraulic fluid is drained to limit the opening of the at least one valve.

10. The control assembly according to claim 1, wherein said valve actuating assembly opens one of said first passageway and said second passageway to drain hydraulic fluid from said passageway during positive power and said movable assembly opens at least one of said first passageway and said second passageway to drain hydraulic fluid from said passageway during an engine braking operation.

11. The control assembly according to claim 10, wherein said valve actuating assembly opens said first drainage passageway during positive power.

* * * * *